United States Patent [19]

Crosby et al.

[11] 4,069,966

[45] Jan. 24, 1978

[54] CENTRIFUGE WITH CHATTER SUPPRESSION

[75] Inventors: Herbert L. Crosby, Plainville; Jacob P. Den Hartog, Concord, both of Mass.

[73] Assignee: Bird Machine Company, Inc., South Walpole, Mass.

[21] Appl. No.: 732,315

[22] Filed: Oct. 14, 1976

[51] Int. Cl.[2] ..... B04B 1/20

[52] U.S. Cl. ..... 233/1 C; 233/7

[58] Field of Search ..... 233/1 R, 1 C, 7, 23 R, 233/23 A; 68/23.1; 308/1; 64/1 V, 2 R, 2 P, 27 B, 28 R, 15 B, 27 L

[56] References Cited

U.S. PATENT DOCUMENTS

| | | | |
|---|---|---|---|
| 399,122 | 3/1889 | Adams et al. | 233/1 C |
| 581,205 | 4/1897 | Hewitt | 233/1 C |
| 2,288,425 | 6/1942 | Simborg | 64/28 R |
| 3,075,406 | 1/1963 | Butler et al. | 64/1 V |
| 3,097,167 | 7/1963 | Beyerle | 233/1 C |
| 3,282,069 | 11/1966 | Wermlinger | 64/27 L |
| 3,552,804 | 1/1971 | Bracken | 308/1 |
| 3,685,722 | 8/1972 | Nichols | 233/23 R |

*Primary Examiner*—George H. Krizmanich
*Attorney, Agent, or Firm*—Edgar H. Kent

[57] ABSTRACT

Chatter is suppressed in a solids-liquid separating centrifuge by including, in an external connection to a holder of the speed change gearing between the centrifuge bowl and conveyor, a spring and mass means which is torsionally resilient about the axis of the connection such that it will vibrate about that axis under chatter conditions at the chatter frequency, together with damping means acting in parallel with the spring and mass means to apply resistance to the torsional vibration thereof and thereby irreversibly extract energy therefrom.

16 Claims, 12 Drawing Figures

FIG 3
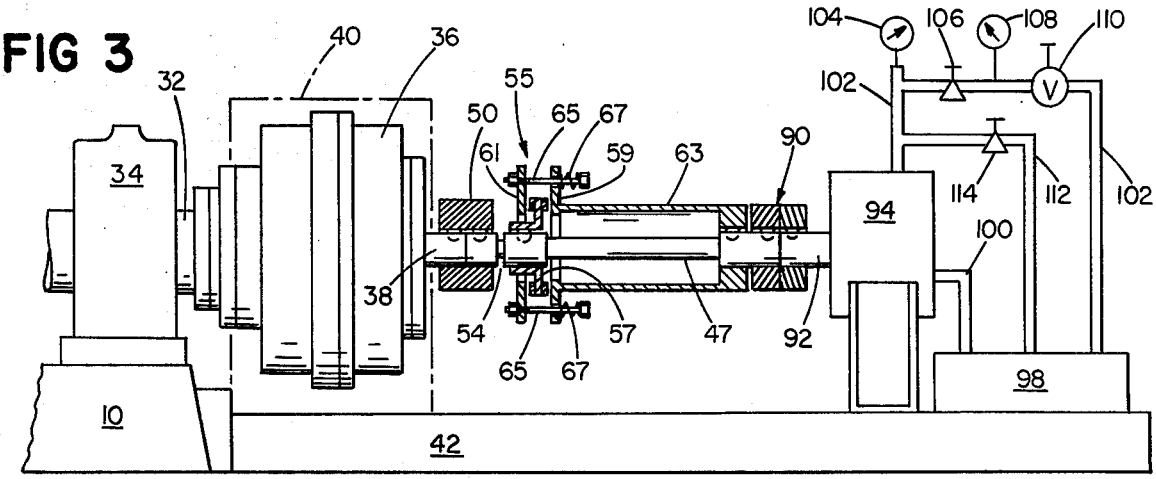
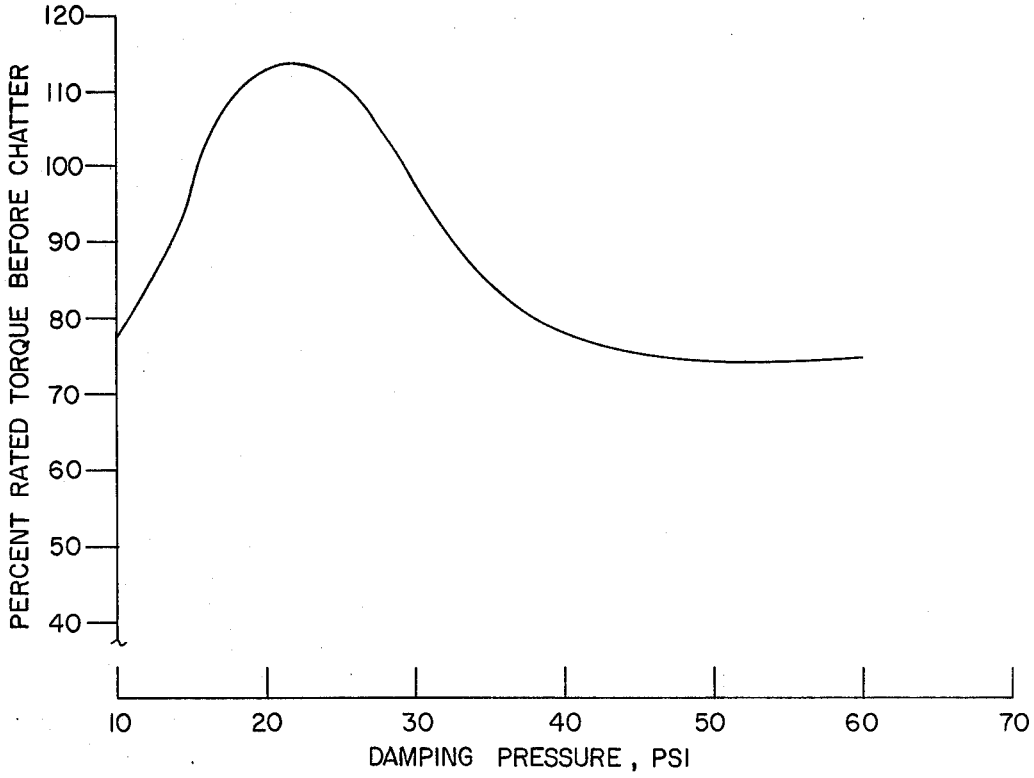
FIG 10

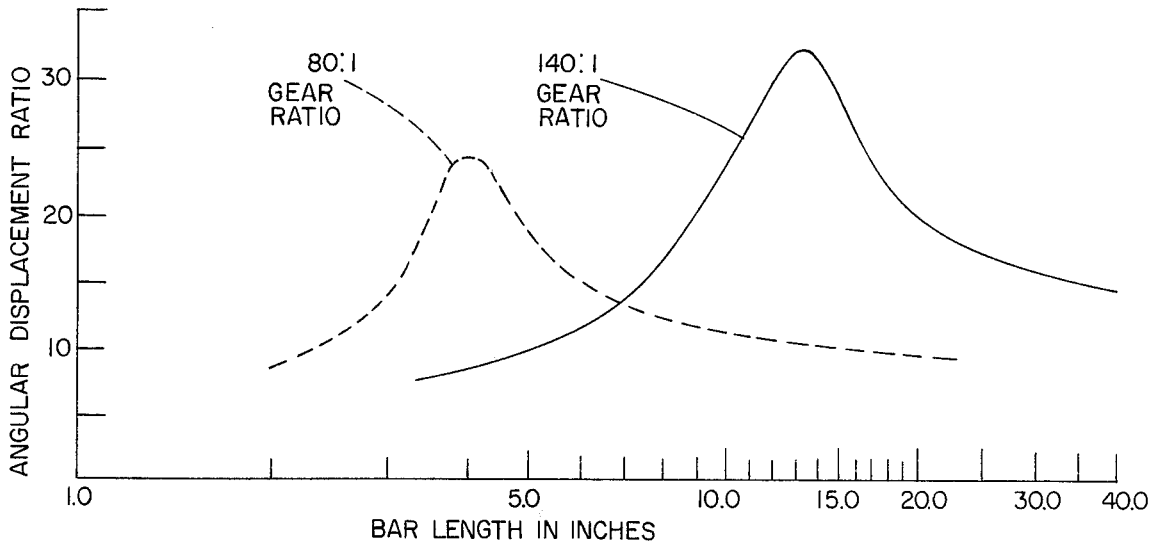
FIG 6 RATIO OF ANGULAR DISPLACEMENT OF 3/8 INCH DIAMETER STEEL TORSION BAR TO THAT OF CONVEYOR AT VARIOUS BAR LENGTHS
| TORSION BAR LENGTH IN INCHES | SPRING RATE LB INCHES / RADIAN |
|---|---|
| 1 | 22,521 |
| 2 | 11,260 |
| 3 | 7,507 |
| 4 | 5,630 |
| 5 | 4,504 |
| 6 | 3,753 |
| 7 | 3,217 |
| 8 | 2,815 |
| 9 | 2,502 |
| 10 | 2,252 |
| 11 | 2,047 |
| 12 | 1,817 |
| 13 | 1,732 |
| 14 | 1,609 |
| 15 | 1,501 |
| TORSION BAR LENGTH IN INCHES | SPRING RATE LB INCHES / RADIAN |
|---|---|
| 16 | 1,408 |
| 17 | 1,325 |
| 18 | 1,251 |
| 19 | 1,185 |
| 20 | 1,126 |
| 25 | 900.8 |
| 30 | 750.7 |
| 35 | 643.5 |
| 40 | 563.0 |
FIG 7 CONVERSION TABLE: TORSION BAR LENGTH VS SPRING RATE 3/8 INCH DIAMETER STEEL TORSION BAR

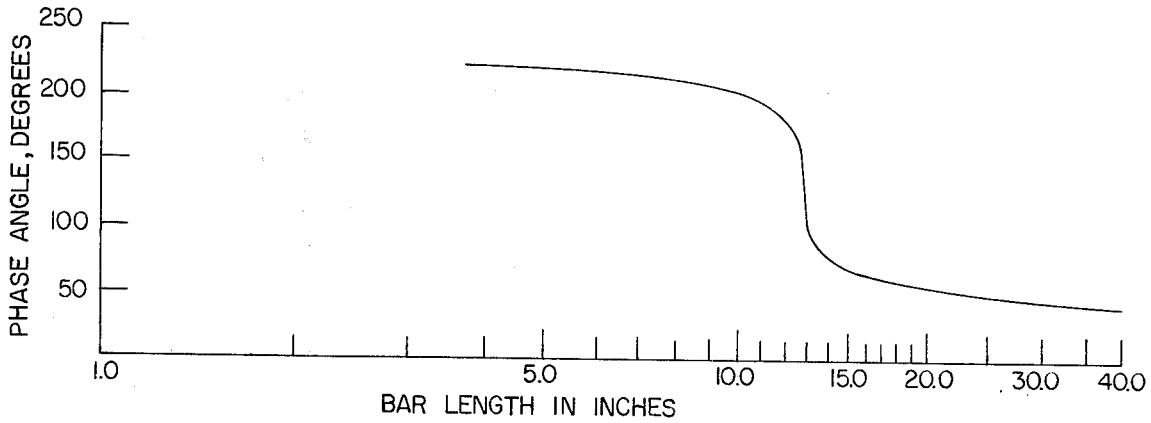
FIG 8 RELATION OF PHASE ANGLE OF VIBRATION OF CONVEYOR TO THAT OF 3/8" DIAMETER STEEL TORSION BAR AT VARIOUS LENGTHS
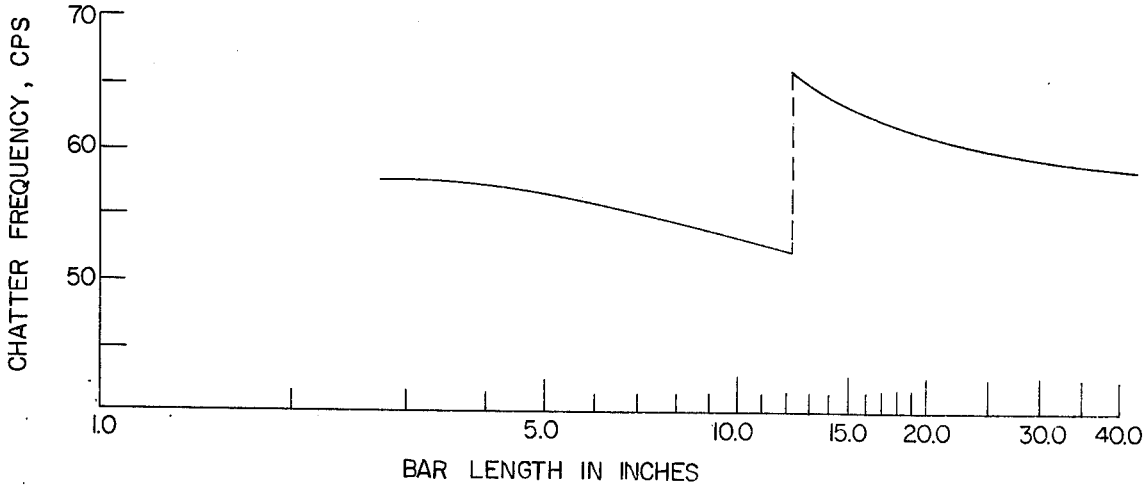
FIG 9 CHATTER FREQUENCY AT VARIOUS LENGTHS OF 3/8 INCH DIAMETER STEEL TORSION BAR

CENTRIFUGE WITH CHATTER SUPPRESSION

BACKGROUND OF THE INVENTION

1. Field of the Invention

This invention relates to solids-liquid separating cetrifuges of the continuous type in which a bowl, imperforate or perforate, and a conveyor are rotated about a common axis in the same direction but at a differential speed. More particularly, the invention concerns the provision of such centrifuges with means for suppressing therein excessive torsional vibration called "chatter".

2. Description of the Prior Art

Centrifuges of the type concerned utilize speed change gearing connected between the bowl and the conveyor so that rotation of one of them by a motor causes the rotation of the other at the differential speed. The conveyor may be rotated faster or slower than the bowl but is normally rotated slower. Either the bowl or the conveyor may be directly driven by the motor, but usually it is the bowl.

Such centrifuges when operated on certain slurries such as starch or similar sticky materials develop the excessive torsional vibration of chatter at throughputs well below rated capacity. Chatter normally occurs at the natural torsional vibration frequency of the centrifuge, typically between 20 and 60 Hz, and is believed to be the result of stick-slip between conveyor and bowl when processing such materials. In the resultant torsional vibrations, the torque in the system fluctuates about the mean, typically from zero to a maximum which may approach or even exceed the maximum torque for which the machine is designed. Such great and rapid torque variations drastically shorten the fatigue life of centrifuge components subject to them, notably of the gears and of the fail-safe overload devices such as a shear pin or friction clutch. Breakage of one or the other soon occurs if chatter is allowed to persist, with consequent great expense in downtime and in replacement cost in the case of the gearing. Yet to avoid chatter, the user may have to operate at throughputs below 40% of rated capacity.

U.S. Pat. No, 3,685,722 discloses that chatter may be inhibited by introducing a resilient flexible connection of lower spring rate between rotating parts of the bowl, conveyor and gearing assembly. Chatter was so suppressed up to full rated capacity of the centrifuge by an elastomeric sleeve secured between the conveyor and its trunnion. However, location of a chatter suppressing device between rotating parts of the assembly imposes certain undesirable restrictions on the design and dimensions of the device and makes access thereto for adjustment or repair difficult.

The speed change gearing utilized in such centrifuges, such as single or multistage planetary, or "Cyclo" gearing, has, in addition to its high torque connections to the bowl and conveyor, a low torque connection to an external holder means, which may be fixed structure or rotating, such as a pinion slip device or a back drive for adjustably changing the differential speed. In the commonly used multistage planetary gearing, this external connection is from the first stage pinion, and its low torque is the torque on the conveyor connection divided by the gear ratio. The external connection normally includes the above-mentioned fail-safe device to prevent torque overload on the machine.

Because of the relatively low torque applied to it and its location external to the bowl-gearing-conveyor assembly, the external connection is an advantageous location for a chatter-suppressing device if such a device, effective in this location, can be provided. Attempts have been made before to suppress chatter by devices included in the external connection. These devices have typically been torsionally resilient elastomeric couplings, or metal springs, arranged to vibrate in response to torsional vibration of the external connection. Such devices have succeeded in suppressing chatter of the external connection to some degree, thus prolonging the life of the fail-safe device and reducing down time due to chatterinduced failure thereof. However, so far as known, they have not been effective to suppress proportionally, or event to any significant extent, chatter of the bowl-gearing-conveyor assembly, and gearing failures due to chatter have persisted at a high rate despite the utilization of such devices.

SUMMARY OF THE INVENTION

The object of this invention is to provide centrifuges of the type concerned with a torsional vibration suppression device acting on or in the external connection of the gearing to effectively suppress chatter of the bowl-gearing-conveyor rotary assembly.

It has been discovered that the object of the invention can be attained by such a device which is properly designed to increase sufficiently the positive damping forces opposing the chatter-inducing torque forces arising within the rotary assembly. To this end, the invention utilizes the combination of a torsionally resilient spring and mass means in the external connection and a separate damping means acting in parallel with the spring and mass means to positively damp its torsional vibration. The spring and mass means has a lower torsional spring rate than any torque carrying component part of the centrifuge rotating assembly, and is connected to transmit torque from the gearing to the holder means. The damping means which is installed in parallel to the spring means provides resistance to angular vibratory motion of the spring and mass means such as to irreversably extract (e.g., as heat) a substantial part of the energy present in that motion.

The spring rate of the spring and mass means is sufficiently low so that it has substantial angular oscillatory movement under chatter-producing torque forces. The optimum spring rate is that at which the spring and mass means vibrates torsionally in resonance with the torsional vibration of the centrifuge rotary assembly under chatter conditions, i.e., at the same or nearly the same frequency, in accordance with the invention set forth in U.S. patent application Ser. No. 732,316, filed simultaneously herewith, owned by the assignee of the present application. Preferably, the spring rate is close to or else lower than such optimum spring rate.

The separate damping means resists the opposite angular movements of the spring and mass means during its torsional vibration, as by frictionally resisting such movements, and acts in parallel so that it does not transmit steady state torque applied to the spring means. The optimum damping force applied by the damping means is that which will extract as much as possible of the energy present in the damped torsional vibratory motion and therefore is most effective. It lies between lower and higher forces which are less effective because they provide too little resistance or suppress the motion too much, respectively. Preferably, the damping means applies damping force at or near optimum, and the damping force applied thereby is adjustable.

The spring of the spring and mass means may be of any suitable torsionally resilient form such, for example, as a torsion bar or coil spring, or a leaf spring assembly. A preferred spring is a solid torsion bar of low inherent damping capacity, which may be made of metal, such as steel or titanium, and is included coaxially in the external connection. The spring rate of the spring may be made adjustable, as by varying the unclamped length of a torsion bar which is free to vibrate torsionally. The mass of the spring and mass means is the mass of the spring and of all other components of the external connection that vibrate torsionally with the spring.

The separate damping means may also be of any suitable form. With the preferred torsion bar spring, a friction disc secured to the bar and a damper acting thereon, or vanes secured to the bar and immersed in damping fluid such as silicone or other oil, have been effective. Preferably, the damping force applied by the damping means is made adjustable, for example, by exerting adjustable pneumatic or hydraulic pressure on the abovementioned friction damper or by varying the extent of immersion of the above-mentioned vanes.

With preferred embodiments of spring and mass and damping means, it has been found possible to effectively suppress centrifuge chatter at feed rates up to and exceeding full rated torque capacity of the centrifuge, with feed slurries which otherwise induced full chatter at feed rates as low as 40% of rated torque capacity. By "effectively suppress" is meant to eliminate, or reduce to harmless proportions such as less than 10% fluctuation from the applied torque.

While chatter occurs at substantially constant frequency in centrifuges of the same or comparable design, differences in design such as size, gear ratio or type of gearing, normally result in differences in the chatter frequency and in various other factors affecting the design of the spring and mass means and separate damping means. Therefore, for best results, it is desirable to design these means specifically for each design of centrifuge, which may be optimum for that particular centrifuge design, but not optimum, or even suitable, for other centrifuge designs.

In designing the spring and mass means for a centrifuge of given design characteristics, the spring rates of the torque carrying components of the rotary assembly being known, a spring of lower spring rate and requisite shear strength can be selected which will have substantial angular motion in response to the vibratory torque caused by chatter when incorporated in the external connection. Optimum damping may then be determined with the spring means in place and provided with damping means capable of applying adjustable damping force thereto, by operating the centrifuge with feed which causes it to chatter, such as P.V.C. beads or starch, usually at a feed rate of about 50% or less of rated capacity wihout damping; and increasing both the feed rate and the damping force until chatter no longer occurs at a maximum desired feed rate, which may be maximum rated torque or higher, or until further increase in damping force does not raise the feed rate at which chatter occurs, or lowers it, meaning that optimum damping force has been reached or exceeded. The design parameters so determined may then be fixed for the spring and mass means and the separate damping means for that given design of centrifuge, although it is preferred to provide adjustable damping in the final design.

However, it is preferred to utilize the invention of the aforesaid patent application by providing a spring and mass means of which the spring has a spring rate such that the spring and mass means vibrates in or near resonance with the torsional vibration of the centrifuge rotary assembly under chatter conditions. In designing such a preferred spring and mass means, as described in said patent application present procedure is to initially determine experimentally for each centrifuge size, gear type and ratio, a spring and mass combination which vibrates torsionally in resonance with the chatter torsional vibration of the centrifuge rotary assembly. A torsion bar spring is connected axially to the external connection of the centrifuge to vibrate therewith in such a manner that its spring rate is adjustable, for example, clamping the end fixed against vibration with a clamp movable longitudinally of the bar to change its effective spring length and hence its spring rate to various calculable values. The centrifuge is operated in chatter with a known chatter producing feed slurry, such as P.V.C. beads or starch, at various adjusted spring rates of the bar until the bar and rotating assembly vibrate in resonance. Various procedures are available for detecting inresonance vibration as follows:

1. The ratios of the amplitude of vibration of the bar to that of the conveyor at the different spring rates are compared until the maximum ratio is found, since at resonance that ratio will be maximum. The amplitude of conveyor vibration may be shown by a torsiograph installed on the conveyor, a suitable torsiograph being available from General Motors Corporation, Warren, Michigan, designated "Velocity Torsiograph No. 44", which provides an electric output corresponding in frequency and amplitude to the torsional vibration of the conveyor which appears as a sine wave on an oscilloscope. The amplitude of vibration of the bar may be determined by a suitable device, which may be a fixed pen, marking on tape applied to a disc or drum mounted on the bar.

2. Passing through resonance, there is a large shift in phase angle between the conveyor vibration and that of the bar. The conveyor vibration motion is shown by the torsiograph and the bar vibration motion may be determined by strain gage torque sensors applied to the bar, with equipment for showing as a sine wave on an oscilloscope fluctuations in direct current applied to the gages. Such gages and equipment are currently in use for the detection of chatter.

3. At resonance, there is a distinct frequency shift of both the conveyor and bar vibration motion. This is shown by both the torsiograph and the strain gage devices, and may be detected with either. The frequencies are compared until the shift occurs.

Two or all procedures may be used to check results. The procedures may be repeated with torsion bars of different diameters to further check results.

The proper combination of spring and mass so determined can then be used as standard for all like centrifuges. However, other springs than the test torsion bar but having the "resonant" spring rate of the latter may be used provided the mass is not changed. Changes in the mass will affect the spring rate of the spring, so that a compensating change in the spring may have to be made. Optimum damping for the spring and mass means so designed may be determined as previously described.

It is noted that in determining the effectiveness of a spring and mass means and separate damping means in suppressing chatter, it is important to measure chatter of the conveyor as described above and not merely of the external connection. This is because, as earlier noted, suppression of chatter in the external connection does not necessarily suppress chatter in the centrifuge rotating assembly. For example, it was found that a long torsion bar of low spring rate without damping would suppress chatter in the external connection but not in the conveyor rotating assembly.

Advantages of closely correlating the natural frequency of vibration of the spring and mass means to the chatter frequency include shorter lengths of torsion bar springs and less damping force required for equivalent results. The saving in extension beyond the centrifuge may amount to several feet and less elaborate and expensive damping equipment can be utilized. In addition, as disclosed in the aforesaid patent application, the in-resonance vibration of the spring and mass means itself has a substantial chatter suppressing effect, which means that chatter suppression to considerably higher torque levels can be obtained with added damping than in cases where the spring does not have the preferred spring rate.

Torsion bars of low inherent damping properties are preferred to those with inherent damping such as elastomeric couplings. Better results have been obtained to date with the former. However, by applying separate damping to an elastomeric coupling, the chatter-free feed rate has been raised from 40% to 75% of rated torque capacity of the centrifuge.

BRIEF DESCRIPTION OF THE DRAWINGS

In the accompanying drawings:

FIG. 3 is a side elevation view, partially in vertical cross-section, showing the invention embodiment of FIG. 1 connected between the centrifuge gearing and an hydraulic backslip device illustrated somewhat diagrammatically;

FIGS. 6, 8 and 9 are curves showing changes in certain ratios or values as a torsion bar was varied in length to bring the natural torsional vibration frequency of the bar and mass into and out of resonance with the chatter torsional vibration of a centrifug rotary assembly;

FIG. 7 is a conversion table for converting lengths of the bar in FIGS. 6, 8 and 9 to corresponding spring rates; and FIG. 10 is a curve showing progressively increasing and decreasing chatter suppression by a preferred spring and mass means and a separate damping means as the damping force applied by the damping means was increased to and beyond the optimum.

DESCRIPTION OF THE PREFERRED EMBODIMENTS

Figure 1:
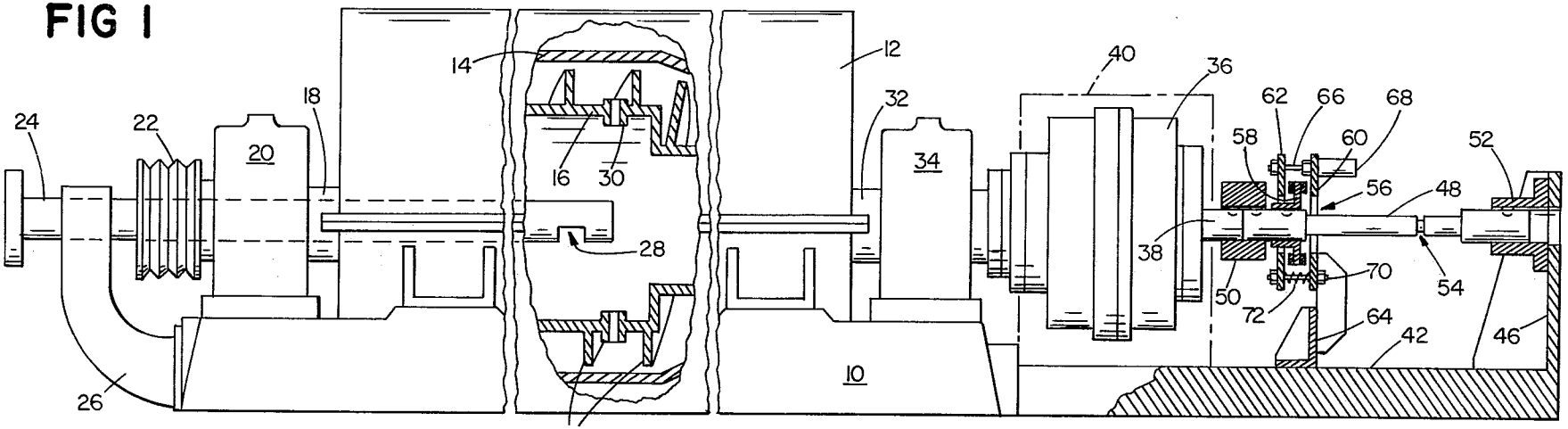
FIG. 1 is a side elevation view, broken away in part and partly in vertical cross-section, of a centrifuge of the type concerned equipped with chatter-suppressing spring and mass means and separate damping means according to the invention.

Referring to FIG. 1, the centrifuge there shown is of the solid bowl continuous type having a rotary assembly of bowl, planetary two-stage gearing and conveyor, of a standard design. A base 10 carries a casing 12 housing the bowl 14 and interior conveyor 16. A hollow drive shaft 18 rotatable in a support 20 on base 10 is connected at one end to the bowl and at the other end has a drive pulley 22 for sheave drive from a motor (not shown). A feed pipe 24, fixedly mounted in an arm 26 on base 10, extends through shaft 18, from an outer end connecting to a source (not shown) for supplying slurry thereto at a regulated rate, to an inner end inside the conveyor with a discharge outlet 28. Ports 30 in the conveyor hub discharge the feed slurry into the bowl. A shaft (not shown) on one end of the conveyor is coaxially rotatably mounted in shaft 18.

A hollow shaft 32 on the bowl extends rotatably through a support 34 on base 10 and is connected to rotate the casing of two stage speed change planetary gearing 36, of which the first stage pinion has a shaft 38 extending externally of the gearing casing and forming part of the external connection of the rotary assembly. A shaft (not shown) connected to the conveyor extends rotatably through shaft 32 and is connected to the second stage of gearing 36 so that it is driven thereby at a differential speed of rotation to that of the bowl, usually a lower speed. A housing 40 may be provided around the gearing, supported on an extension 42 of base 10.

Bowl 14 and one or more helical conveyor blades 44 on conveyor 16 have matching contours, cylindrical at one end and tapering, frusto-conical at the other, as indicated. The solids separating toward the bowl are moved by the conveyor from left to right in FIG. 1 to outlet ports (not shown) in the right-hand bowl end, from which they dscharge to a chute (not shown) in casing 12. The clarified liquid flows from right to left in FIG. 1 to outlet ports (not shown) in the left-hand end of the bowl, and discharges to a receiving conduit (not shown) in casing 12.

In FIG. 1, the holder means for the external connection from the gearing 36 is a fixed support member 46 on base extension 42. The external connection includes first stage pinion shaft 38 and a spring and mass means in which the spring is a torsion bar 48 coaxially fixed at one end to shaft 38 by clamp 50, and fixedly mounted at the other end in socket clamp 52 on holder member 46 fixed to base extension 42, the mass being that of bar 48, clamp 50, friction disc 58 hereinafter described, the pinion and its shaft 38 and possibly other gearing components. The clamps are of usual type, including keys engaging in slots in the bar as indicated. Torsion bar 48 may, as shown, be provided with a reduced diameter portion 54 of lowered shear strength which acts as the usual fail-safe shear pin on torque overload. Alternatively, a conventional shear pin may be clamped between bar 48 and shaft 38.

Torsion bar 48 has length and diameter dimensions to provide a spring rate which is lower than that of any torque transmitting component of the centrifuge rotary assembly and preferably such that the natural frequency of torsional vibration of the bar and mass is at or near resonance with the torsional vibration of the centrifuge rotating assembly under chatter conditions. The bar is preferably cylindrical and made of metal such as steel or titanium, although other material of adequate shear strength and resilience may be used, such as fiberglass.

The damping means, indicated generally at 56, comprises a friction disc 58 fixed to bar 48 and having friction facings on its opposite surfaces radial to the bar. A fixed damping member 60 and a movable damping member 62 are arranged to grip between them, on suitable adjustment of member 62, the friction facings on disc 58. Damping member 60 is fixed to bracket 64 secured to base extension 42. Damping member 62, movable axially of bar 48, is connected by rods 66 fastened by nuts thereon to the pistons of pull type pneumatic cylinders 68 (one shown), connected to a suitable source (not shown) of pneumatic or hydraulic pressure. Cylinders 68 alternate circumferentially of bar 48 with bolts 70 extending loosely through member 62 and fastened by nuts to member 60, rods 70 having surrounding coil springs 72. Adjustable damping is thus applied to bar 48 as it twists under torsional vibration by applying selected pressure to cylinders 68 to squeeze the friction surfaces of disc 58 between the damping members 60 and 62, against the action of springs 72.

Figure 2A:
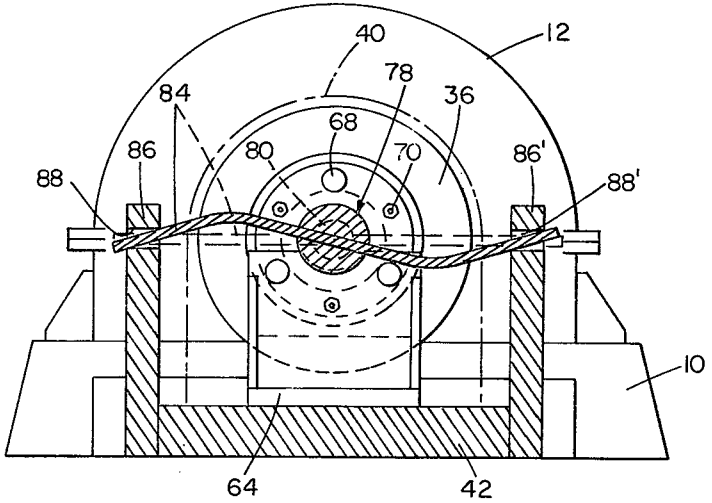
FIGS. 2 and 2*a* are respectively side and end elevation views, partially in vertical cross-section, of an end portion of the centrifuge of FIG. 1, showing another embodiment of the the invention.
Figure 2:
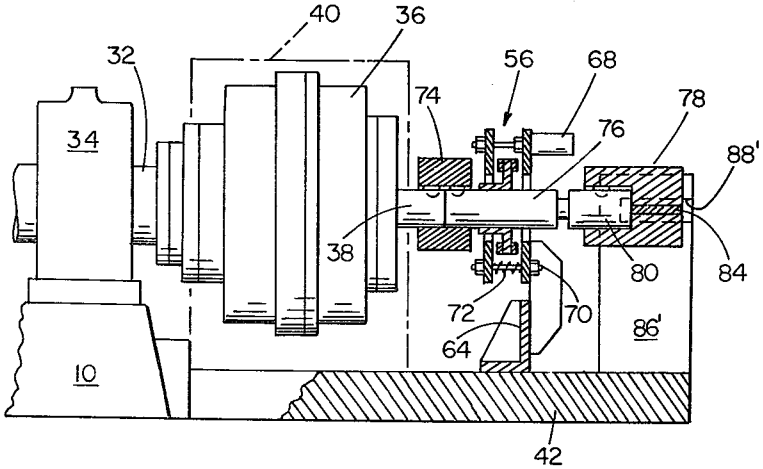

FIGS. 2 and 2*a* illustrate a modified embodiment of spring and mass means with separate means according to the invention. A clamp 74 secures to the end of shaft 38 one end of a short shaft 76 in axial alignment with shaft 38. Shaft 76 has at the outer end thereof a double clamp designated generally 78 formed at its inner end as a socket clamp 80 with keys to clamp onto the end of a shaft 76, and at its outer end as a split flat clamp 82 the two jaws of which clamp the midportion of a spring means formed by a flat leaf spring member 84. Clamp 78, like the other clamps previously mentioned, may be formed in two halves connected together by bolts (not shown) at opposite sides of the clamp axis. The shaft 76 may have, as indicated, a reduced diameter intermediate portion forming a shear pin.

A pair of fixed supports 86, 86' at either side of base extension 42 are provided with slots 88, 88' aligned with each other and with the axis of clamp 78, slots 88, 88' slidably receiving the opposite ends of spring member 84 and connecting the spring member to the holder formed by supports 86, 86'. When the centrifuge is idle, spring member 84 is straight, extending horizontally between slots 88, 88' as indicated by the dash line showing in FIG. 2*a;* whereas, with the centrifuge under torque load, spring member 84 bows at either side of clamp 78 toward the direction of torque load, clockwise in FIG. 2*a,* as shown in full lines in that FIG.

As in the case of torsion bar 48, spring member 84 has a torsional equivalent spring rate lower than that of any torque transmitting component of the centrifuge rotating assembly, and in this case also a lower spring rate than shafts 76 and 38 and clamp 78, forming the remainder of the external connection of gearing 36 to holder means 86, 86'. Also, preferably spring member 84 has dimensions which provide a spring rate such that the natural frequency of vibration of the spring member and mass is at or near resonance with the torsional vibration of the centrifuge rotary assembly under chatter conditions.

In the embodiment of FIGS. 2 and 2*a,* flexing of spring member 84 permits shafts 38 and 76 and clamp 78 to rotate. The oscillatory rotary motion of shaft 76 during torsional vibration is frictionally resisted and thereby damped by damping means 56 in the same manner as it resists and damps torsional vibration of bar 48 in FIG. 1.

An advantage of the embodiment of FIGS. 2 and 2*a* over that of FIG. 1 is that it may require, as indicated, less extension of the centrifuge in the axial direction. While a spring extended to only one side of the axis of clamp 78 could be used, this would exert undesirable bending forces on the remainder of the external connection.

A spring and mass means according to FIGS. 2 and 2*a* can be turned to the desired natural, torsional vibration frequency in manner similar to a torsion bar and mass as described earlier herein. Thus, supports 86, 86' may be made adjustable toward and away from one another so that the effective spring length of spring member 84 is shortened or lengthened, thereby raising or lowering its spring rate until a condition of resonance is attained.

The holder means for the external connection may be rotary, rather than fixed as in FIGS. 1, 2 and 2*a*. For example, FIG. 3 shows the outer end of a torsion bar 47 similar to the bar 48 of FIG. 1, in the external connection as in FIG. 1, with a modified damping means, clamped by a clamp 90 in axial alignment to the pump shaft 92 of the rotary positive displacement hydraulic pump 94 of a pinion back slip device mounted on base 42, pump shaft 92 and pump 94 being the holder means in this case. In conventional manner, the torque on the external connection drives pump 94 to pump hydraulic fluid from a sump 98 through line 100, the pump, a line 102, past a pressure indicator 104, through a pressure regulator 106, past a pressure indicator 108, through a flow control valve 110 back to sump 98. Regulator 106 passes a pre-set pressure irrespective of variation of torque applied to the pump, while valve 110 passes a predetermined fluid flow at that pressure. In this manner, the rate at which the pump can rotate is controlled by the amount of fluid flow allowed to pass valve 110. A bypass line 112 from line 102 to the sump, with relief valve 114, prevents excess pressure buildup by sudden torque increases.

The damping means, designated generally 55, has been modified to enable rotation thereof with the external connection while damping twisting of the bar under torsional vibration as in FIG. 1. It has a friction disc 57 fixed to bar 47 and damping members 59 and 61 like the corresponding parts 58, 60 and 62, respectively, of FIG. 1. However, the member 59, instead of being fixed to base 42 like member 60 in FIG. 1, is fixed to one end of a sleeve 63 which loosely surrounds bar 47 and is secured by a key to the outer end of the bar adjacent clamp 90. Damping member 61, movable axially of bar 47 relative to member 59, has bolts 65, fixed by nuts thereto, which extend loosely through apertures in member 59. A coil spring 67 surrounds the shank of each bolt 65, bearing at its ends on member 59 and the bolt head.

Springs 67 replace the pneumatic system of FIG. 1 for applying adjustable pressure to squeeze disc 57 between the damping members. Such pressure is pre-set by adjusting the length of bolts 65 extended through member 61 to provide the desired spring compression and pressure. The damping action is the same as in the embodiment of FIG. 1.

If valve 110 is closed, bar 47 and pinion shaft 38 are held essentially fixed against rotation, as they are in FIG. 1. With valve 110 open, rotation of the bar, the shaft and the first stage pinion take place at a pre-set rate, changing accordingly the differential speed produced by the differential gearing 36.

The external connection may also be connected to a rotary back drive as the holder means. A back drive can be used to rotate the external connection in either direction. It uses an hydraulic motor and hydraulic pump in a drive and/or driven relationship depending on torque. Other types of back drives can be used. With a rotary holder for the external connection, the torsion bar form of spring means is used, the form shown in FIGS. 2 and 2*a* being unsuitable.

Figure 4:
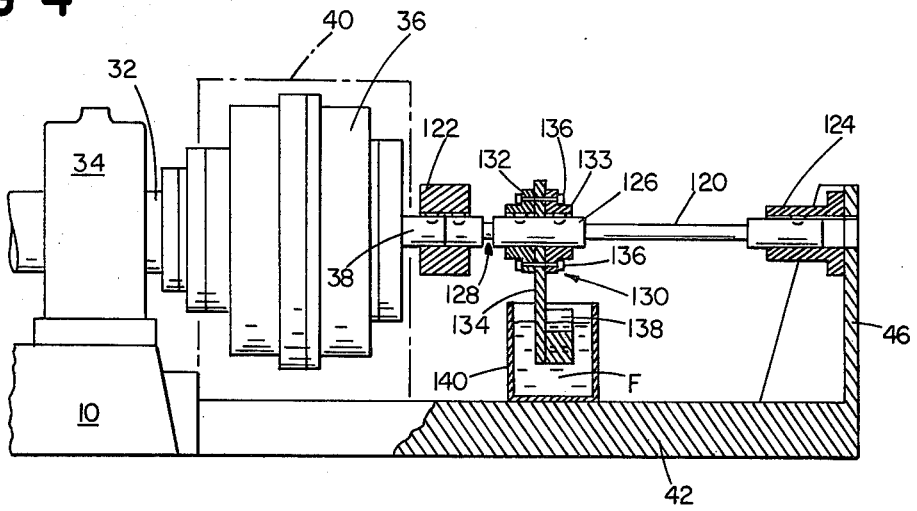
FIGS. 4 and 4*a* are views similar to FIGS. 2 and 2*a* respectively of another embodiment.
Figure 4A:
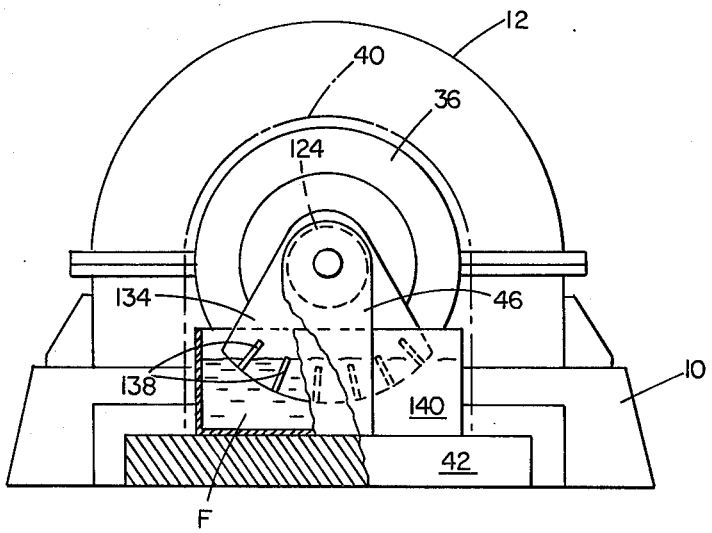

FIGS. 4 and 4*a* show another embodiment of spring and mass means and separate damping means in the external connection of the centrifuge shown in the previous Figures. The spring of the spring and mass means is a torsion bar 120 similar to torsion bar 48 of FIG. 1. One end of bar 120 is clamped by clamp 122 in axial alignment to shaft 38, while its other end is fixed by socket clamp 124 to fixed support 46. Bar 120 has an enlarged end portion 126 fitting clamp 122, with a reduced, fail-safe shear portion 128 adjacent the clamp. The separate damping means, designated generally 130, is non-rotatably mounted on enlarged portion 126 outwardly of portion 128 by a pair of clamps 132, 133.

Clamps 132, 133 are provided with abutting flanges between which the narrow end of a sector-shaped plate 134 is fastened by bolts 136 extending through aligned apertures in the plate and the flanges of the clamps, plate 134 being provided with an aperture through which enlargement 126 extends. Plate 134 has fixed thereto adjacent its larger end a plurality of projecting vanes 138 which extend axially of bar 120 and are disposed within a tank 140 mounted on base extension 42. A fluid F in tank 140 may be adjusted in level so that all vanes 138 are wholly submerged therein, or so that some or all vanes are only partly submerged.

Torsional vibration of bar 120 causes plate 134 to oscillate about the axis of shaft 120 and such action is resisted or damped by engagement of vanes 138 with the fluid F, to a greater or lesser degree depending on the fluid level. As in FIG. 1, it will be noted that the damping means is located near the end of bar 120 attached to shaft 38, where the angular motion of the bar during torsional vibration is greatest and consequently the damping is most effective.

Figure 5:
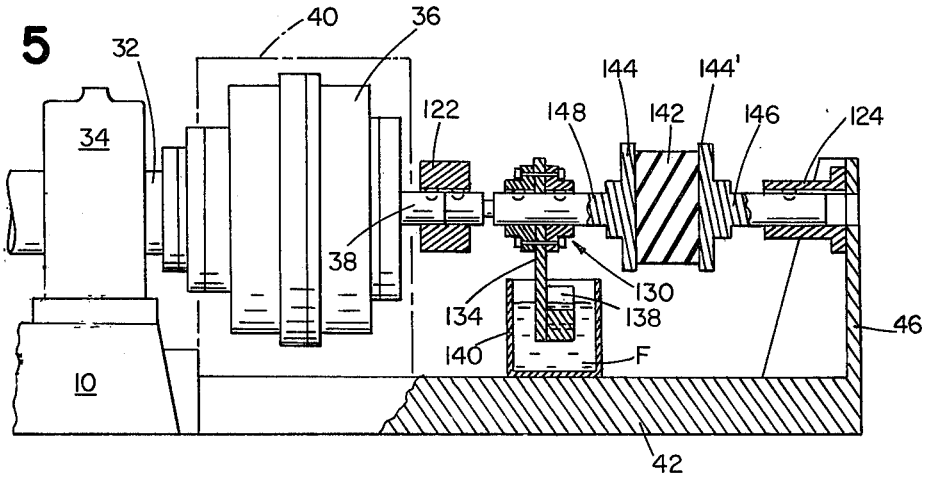
FIG. 5 is a view similar to FIG. 4 of a modification of that embodiment.

FIG. 5 shows the same damping means as in FIGS. 4 and 4*a* but attached to a different embodiment of the spring and mass means. In FIG. 5 the spring member is a torsionally resilient coupling 142 of rubber composition or other elastomer having rigid end caps 144, 144' secured thereto. A shaft 146 has one end secured to cap 144' and its other end fixed in socket clamp 124 on fixed holder means 46. A shaft 148, which is essentially a duplicate of the left-hand half of bar 120 of FIG. 4, has one end secured to cap 144 and its other end attached to shaft 38 by clamp 122 and having the movable assembly of the damping means 130 mounted thereon.

In the FIG. 5 embodiment, coupling 142 twists in response to torsional vibration of the centrifuge rotary assembly, causing corresponding rotary oscillation of shafts 148 and 38 which in turn oscillates vanes 138 to and fro in the fluid in tank 140, providing the damping action.

Although not preferred, it is possible to design a satisfactory spring member for the spring and mass means, separate damping means system which does not have a natural frequency of torsional vibration at or near resonance with the chatter frequency of the rotary assembly in the particular centrifuge to which the system is applied. In such case, the spring member should have a lower spring rate than that which would provide resonance, so that its angular deflection under applied torque is large, for example greater than 10° at full rated torque load. This in turn means that the torsion bar needs to be relatively long to provide the low spring rate and requisite strength.

For example, two titanium torsion bars of $\frac{3}{4}$ inch diameter, equipped with both friction type damping with friction applied directly to the bar and fluid type damping like that of FIGS. 4, 4*a* and 5, were designed for testing in the external connection of a 32 inch diameter by 50 inch long bowl centrifuge of standard make that was experiencing chatter problems in the field. One bar had a length of 28 inches and a deflection of 19.9° under maximum rated torque of the centrifuge and the other a length of 22 inches and a deflection of 15.6° under maximum rated torque. They were incorporated successively in the external connection of the centrifuge in similar fashion to the torsion bar of FIG. 1, replacing the standard, relatively stiff torque arm with which full chatter was being experienced at a feed rate corresponding to only 40% of rated torque capacity.

Both bars were tested with both the fluid and friction damping acting together, with the friction damping only, and with no separate damping. With both types of damping acting together, chatter was suppressed by both bars at feed rates up to 100% rated torque capacity and there was practically no torque variation. With friction damping only, both bars again suppressed chatter at feed rates up to 100% of rated torque capacity, but there was more torque variation, although less than ±10%. Without damping, full chatter developed with both bars at a feed rate of 40% of rated torque capacity.

Since both bars with damping were fully effective to suppress chatter in the centrifuge for which they were designed, it was evident that the shorter torsion bar had a sufficiently low spring rate and sufficiently high angular deflection under torque.

The tests with the two titanium bars also showed that the bars were unnecessarily overdamped with the full amount of damping provided but not to a harmful extent. As hereinafter appears, overdamping can seriously impair or even destroy damping effectiveness. The full damping was in fact better than friction damping alone, since it virtually eliminated any vibration at the chatter frequency, as compared with the low level vibration experienced with direct friction damping alone.

Despite their effectiveness in the spring and mass means, separate damping means system, the length of the untuned torsion bars presented a practical problem. The 22 inch long bar when attached extended the centrifuge axial length by 36 inches, and the 28 inch bar added 6 inches more. Such amount of extension is at best awkward and inconvenient and in many cases is prohibited by space limitations. Efforts to resolve this problem led to the development of the spring means and damping means design of FIGS. 2 and 2*a*, which requires only a short extension of centrifuge axial length. However, this design is more elaborate and expensive than the torsion bar. More important was the discovery that effective spring and mass means of considerably higher spring rate can be utilized, provided their natural frequency of torsional vibration is at or near resonance with the torsional vibration frequency during chatter of the rotary assembly of the centrifuge with which they are associated. This means that much shorter torsion bars or other springs can be used, with important space savings as well as in cost reduction. The spring and mass means with so-tuned natural frequency of torsional vibration is therefore preferred.

FIGS. 6–9 correspond to figures of the aforesaid patent application. FIGS. 6, 8 and 9 are curves derived from plots of various values measured in arriving experimentally at spring and mass combinations having the preferred torsional vibration in resonance with the chatter torsional vibration when incorporated in the external connection of a centrifuge of the type concerned of standard make with an 18 inch diameter by 28 inch long bowl. Torsion bar springs were used in deriving the data, connected as in FIG. 1 except that fixed support 46 and clamp 52 were replaced by a movable clamp and support assembly, so that the effective spring length of the bar between that clamp and the clamp 50 could be varied. For the curves shown, the torsion bar was of steel with a diameter of 0.375 inches, and the mass vibrating with the spring was maintained at a constant value. The conveyor was equipped with a torsiograph and strain gage sensors were applied to the external connection, with outputs connected to oscilloscopes. The centrifuge was operated on a feed slurry of P.V.C. beads which caused it to chatter, normally at a feed rate of about 50% rated torque capacity. The bar lengths of FIGS. 6, 8 and 9 can be converted from the table of FIG. 7 to the corresponding spring rates in terms of pound inches of torque per radian of deflection.

In deriving the curves of FIG. 6, the ratios of the extent of angular movement in chatter of the pinion end of the bar to that of the conveyor at spring rates of the bar corresponding to various effective spring lengths thereof were plotted, with the ratios the ordinates, and the inch lengths the abscissae. The ratios were obtained for two interchangeable gear units of the same type but of different ratios:—an 80:1 ratio used for the dash line curve and a 140:1 ratio used for the full line curve. The angular movement values for the conveyor were obtained by measuring the amplitude peak to peak of the oscilloscope tracings of its vibration. Since the strain gage sensors do not directly measure amplitude of angular motion, such amplitude was obtained for the bar by measuring the length of markings of a fixed pen on tape applied to a disc or drum mounted on the bar.

It will be observed that the maximum ratio, indicating in-resonance vibration of the bar and rotary assembly, for the 80:1 ratio gear unit occurred at the bar spring rate at a four inch length of 5,630 pound inches per radian on the FIG. 7 table and for the 140:1 ratio gear unit occurred at the bar spring rate at a 13 inch length of 1,732 pound inches per radian on the FIG. 7 table. The curves rise and fall rather steeply over a relatively short range of effective spring lengths of the bar.

The curve of FIG. 8 shows the relation of the phase angle of vibration of the conveyor to that of the bar at various lengths of the bar in the tests used to establish the curve for the 140:1 gear unit in FIG. 6. The phase angles were compared from the oscilloscope tracings of the torsiograph and strain gage outputs, respectively. It will be noted that the phase angle shifted nearly 180° over the range of lengths tested, most of the change occurring at the bar length at resonance as shown by the full line curve of FIG. 6. The relationship shown by this curve can be used as an alternative indication of the desired resonant natural frequency of torsional vibration of the bar to the ratio of angular motion used for the FIG. 6 curves, or as a supplement thereto.

The curve of FIG. 9 was established from chatter frequency determinations at the various bar lengths in the tests establishing the 140:1 gear unit curve of FIG. 6 and the curve of FIG. 8. It will be seen that the chatter frequency dropped gradually about 5 cycles per second as the effective spring length of the bar was increased from minimum toward the length at which in-resonance vibration occurred as shown in FIGS. 6 and 8. At the in-resonance length, the chatter frequency increased abruptly more than 10 c.p.s., as indicated by the dash line, then declined slowly at longer lengths. This abrupt chatter frequency change can be used as another alternate or supplemental indication that the desired bar length has been attained. Since chatter frequency is shown by the strain gage output as well as by that of the torsiograph, this procedure has the advantage that it requires only one of these instruments.

As effective torsion bar length approaches the resonance length, it becomes necessary to increase the feed rate in order to cause chatter. This shows that at lengths corresponding to resonance or nearly so, the bar becomes effective as a chatter suppressing device. In fact, at the resonant length, chatter was effectively suppressed at feed rates up to 80% of rated torque capacity, as compared with full chatter encountered with bar lengths outside the vicinity of the resonance lengths at a feed rate of 50% of rated torque capacity.

The mass of the spring and mass means is desirably kept low, consistent with design requirements. In general, the spring rate of its spring should be less than 30% above that at which in-resonance vibration of the spring and mass means and the centrifuge rotary assembly will occur.

FIG. 10 shows the effects on chatter suppression of increasing the damping force of the damping means on the spring and mass means through and beyond optimum. The spring and mass means and separate damping means used in developing the data on which the curve is based were like those of FIG. 1, attached to the same centrifuge used for the curves of FIGS. 6, 8 and 9. The torsion bar spring of the spring and mass means had the preferred spring rate such that it vibrated torsionally in resonance with the torsional vibration in chatter of the centrifuge rotary assembly; and without damping it was effective to suppress chatter sufficiently to raise the chatter-free feed rate from 50% of rated torque capacity to 80% thereof.

It will be seen that as the damping force, measured as p.s.i. exerted to force together the frictionally engaged damping surfaces and shown as the abscissae, increased from an ineffective 10 p.s.i. to between 20 and 25 p.s.i., the percent rated torque before chatter, shown as the ordinates, increased rather sharply from an initial 80% to a maximum or optimum above 110%. Further increases in damping force were deleterious, reducing the torque before chatter until, at near 40 p.s.i. and above it was less than 80%, meaning that the torsion bar was less effective with such excessive damping than it was with no damping at all.

Similar data for torsion bars not having the preferred spring rate produce similar curves, but with the starting and maximum torque before chatter lower, and with the curve declining more gradually at damping forces beyond optimum with torsion bars of spring rates lower than the preferred rate, more damping pressure being generally required to attain optimum damping.

We claim:

1. In a solids-liquid separating centrifuge of the type which includes an assembly of a rotary bowl member, a rotary conveyor member mounted coaxially therein, and speed change gearing connected between said members so that rotationally driving one of them rotationally drives the other in the same direction at a differential speed, and a torque-transmitting external connection between said gearing and a holder means, the torque on said external connection being relatively low compared to the torque on the connections between said gearing and said bowl and conveyor;

the improvement for suppressing chatter of said assembly wherein:

said external connection comprises spring and mass means which is torsionally resilient about the axis of said external connection such that it will vibrate about said axis during chatter of said assembly at the same frequency and has a spring rate lower than that of any torque transmitting component of said assembly; and separate damping means acting in parallel with said spring and mass means to apply resistance to the torsional vibration motion thereof and thereby irreversably extract energy therefrom.

2. A centrifuge according to claim 1 wherein said holder means is fixedly mounted.

3. A centrifuge according to claim 1 wherein said holder means is rotatably mounted.

4. A centrifuge according to claim 1 wherein the spring rate of the spring of said spring and mass means is less than 30% above a spring rate at which said spring and mass means will vibrate torsionally in resonance with the torsional vibration of said assembly during chatter.

5. A centrifuge according to claim 1 wherein the spring of said spring and mass means has a spring rate such that said spring and mass means will vibrate torsionally in resonance with the torsional vibration of said assembly during chatter.

6. A centrifuge according to claim 1 wherein said separate damping means is arranged to apply said resistance to the torsional vibration motion of said spring and mass means adjacent its area of maximum such motion.

7. A centrifuge according to claim 1 wherein said separate damping means comprises a member in said spring and mass means vibrating torsionally therewith and resistance means for applying said resistance to the motion of said member.

8. A centrifuge according to claim 7 wherein said resistance means comprises means for applying static resistance to the motion of said member.

9. A centrifuge according to claim 7 wherein said resistance means comprises means for applying fluid resistance to the motion of said member.

10. A centrifuge according to claim 1 wherein said separate damping means includes means to adjustably vary said resistance applied thereby.

11. A centrifuge according to claim 1 wherein said spring and mass means comprises a torsion bar coaxial with said connection and having substantially no inherent damping.

12. A centrifuge according to claim 1 wherein said spring and mass means comprises an elastomeric coupling member coaxial with said connection.

13. A centrifuge according to claim 11 wherein said torsion bar includes a portion of reduced diameter and shear strength, said reduced shear strength being low enough to fracture in the event of predetermined torque overload of said assembly.

14. A centrifuge according to claim 2 wherein said spring and mass means comprises a spring member having its effective spring portion spaced radially outwardly from the axis of the gearing end of said external connection.

15. A centrifuge according to claim 14 wherein said spring member comprises a leaf spring connected centrally to the gearing end of said external connection and connected adjacent opposite ends thereof to said holder means.

16. A centrifuge according to claim 1 wherein said external connection comprises a pinion shaft of said gearing.

* * * * *